US008608934B2

(12) United States Patent
Griffin

(10) Patent No.: US 8,608,934 B2
(45) Date of Patent: Dec. 17, 2013

(54) NICKEL-ZINC-ALUMINUM-HYDROGEN PRODUCTION REACTOR AND METHODS OF USE

(75) Inventor: Linnard Gene Griffin, Bertram, TX (US)

(73) Assignee: G & M Energy Systems, LLC, Farmers Branch, TX (US)

( * ) Notice: Subject to any disclaimer, the term of this patent is extended or adjusted under 35 U.S.C. 154(b) by 995 days.

(21) Appl. No.: 12/691,559

(22) Filed: Jan. 21, 2010

(65) Prior Publication Data

US 2010/0181204 A1 Jul. 22, 2010

Related U.S. Application Data

(60) Provisional application No. 61/146,191, filed on Jan. 21, 2009.

(51) Int. Cl.
*C25B 1/02* (2006.01)
*C25B 11/06* (2006.01)

(52) U.S. Cl.
USPC ..... 205/339; 205/638; 204/242

(58) Field of Classification Search
USPC ..... 205/339, 638
See application file for complete search history.

(56) References Cited

U.S. PATENT DOCUMENTS 4,202,744 A * 5/1980 Pan et al. ..... 205/339
4,547,278 A * 10/1985 Hall et al. ..... 204/290.02
2006/0188436 A1* 8/2006 Griffin ..... 423/657

* cited by examiner

*Primary Examiner* — Jonathan Johnson
*Assistant Examiner* — Bryan D. Ripa
(74) *Attorney, Agent, or Firm* — Gardere Wynne Sewell LLP

(57) ABSTRACT

The technology provides apparatus and methods for generating hydrogen without applying electrical energy from an outside source. An exemplary apparatus has an outer housing having an interior divided into an upper portion and a lower portion separated by a septum. The lower portion contains an electrolyte and a composite electrode at least partially immersed in the electrolyte. The electrolyte includes zinc hydroxide dissolved therein. The composite electrode has an aluminum tube enclosing at least one magnet. An outer surface of the electrode housing is at least partially covered with nano-particles held in place by magnetic attraction of the at least one magnet to form the electrode. The magnetically-adherent nano-particles form a second electrode, in direct contact with the first electrode. The generator apparatus has a vent in communication with the upper portion of the interior of the outer housing for removal of generated hydrogen.

10 Claims, 2 Drawing Sheets

NICKEL-ZINC-ALUMINUM-HYDROGEN PRODUCTION REACTOR AND METHODS OF USE

BACKGROUND

1. Technical Field

The technology relates to the production of hydrogen gas in a generator that includes a pair of electrodes and an electrolyte, and more particularly relates to the production of hydrogen without applying an external source of electrical energy to the electrodes, wherein at least one electrode comprises magnetic nano-particles.

2. Description of the Related Art

Hydrogen gas is a valuable commodity with many current uses and potentially wide ranging future uses. Currently many countries are evaluating the installation of a "hydrogen highway" that would provide hydrogen refueling stations for a national fleet of hydrogen-powered vehicles. Currently, several auto manufacturers (e.g., BMW and Honda) are demonstrating hydrogen powered vehicles.

Aside from the potential for large scale uses of hydrogen to power automobiles, hydrogen also potentially provides a clean fuel from which to generate electricity for other purposes. This is especially desirable if the production of hydrogen does not generate greenhouse gasses, or otherwise has a "small carbon footprint" so that it has potential environmental benefits over fossil fuels.

One of the methods of generating hydrogen is by the electrolysis of water in an electrolysis cell. However, this method requires an input of electrical energy that might be generated by combustion of fossil fuels thereby releasing carbon dioxide and other greenhouse gasses into the environment.

SUMMARY

An exemplary embodiment provides an apparatus for generating hydrogen. The apparatus includes an outer housing having an interior divided into an upper portion and a lower portion separated by a septum. The lower portion contains an electrolyte comprising zinc hydroxide dissolved therein, and nano-particles comprising nickel. The lower portion also contains a first electrode at least partially immersed in the electrolyte. The first electrode has several features including a non-ferrous, conductive electrode housing enclosing at least one magnet, with the electrode housing at least partially covered with nano-particles of nickel, tungsten, cobalt, or alloys of these. In addition, the lower portion of the outer housing contains a second electrode of aluminum that is at least partially immersed in the electrolyte. The generator also has a vent in communication with the upper portion of the interior of the housing for removal of generated hydrogen.

Another exemplary embodiment provides an apparatus for generating hydrogen that has an outer housing having an interior divided into an upper portion and a lower portion separated by a septum. The lower portion contains an electrolyte and a composite electrode at least partially immersed in the electrolyte. The electrolyte includes zinc hydroxide dissolved therein. The composite electrode has several features including a non-ferrous, conductive electrode housing enclosing at least one magnet. An outer surface of the electrode housing is at least partially covered with nano-particles held in place by magnetic attraction of the at least one magnet to thereby form another electrode in direct contact with the first electrode. The nano-particles may be of nickel, iron, tungsten, cobalt, or alloys of these. The generator apparatus has a vent in communication with the upper portion of the interior of the outer housing for removal of generated hydrogen.

Another exemplary embodiment provides a method of generating hydrogen gas without applying electrical energy from an outside source. The method includes the steps of providing an electrolyte comprising zinc hydroxide, and disposing a first electrode comprised of aluminum in the provided electrolyte. It also includes disposing a second electrode comprised of a non-ferrous housing in the electrolyte. The non-ferrous housing contains at least one magnet and the outer surface of the housing is at least partially covered with nano-particles of nickel, tungsten, iron, cobalt, or alloys of these. In addition, the steps include producing hydrogen gas at the first electrode without applying a current from an external source to the first electrode or to the second electrode, and collecting the hydrogen gas produced.

A further exemplary embodiment provides yet another method of generating hydrogen gas without applying electrical energy from an outside source. The method includes the steps of providing an electrolyte that includes zinc hydroxide, and disposing a first electrode in the provided electrolyte. The first electrode is comprised of aluminum and has a cavity formed therein that contains at least one magnet. An outer surface of the first electrode is at least partially covered with nano-particles that form a second electrode in contact with the first electrode. The steps further include producing hydrogen gas without applying an external current to the electrode, and collecting the hydrogen gas produced in the generator.

BRIEF DESCRIPTION OF THE DRAWINGS

For a more complete understanding of the present technology, reference is now made to the following descriptions taken in conjunction with the following drawings that are not to scale, in which.

DETAILED DESCRIPTION

The exemplary embodiments provide hydrogen generators that do not require the input of energy from an external source. More particularly, the consumables for the exemplary embodiments of hydrogen generators include aluminum electrodes and water only. At least one electrode has a non-ferrous housing containing at least one magnet, and nano-particles adhered thereto by magnetic forces. In another feature, a coating of magnetic nano-particles is either used to form an electrode or to form an integral part of an electrode. In addition, the initiation, termination and rate of hydrogen generation may be controlled by relatively simple mechanisms.

Figure 1:
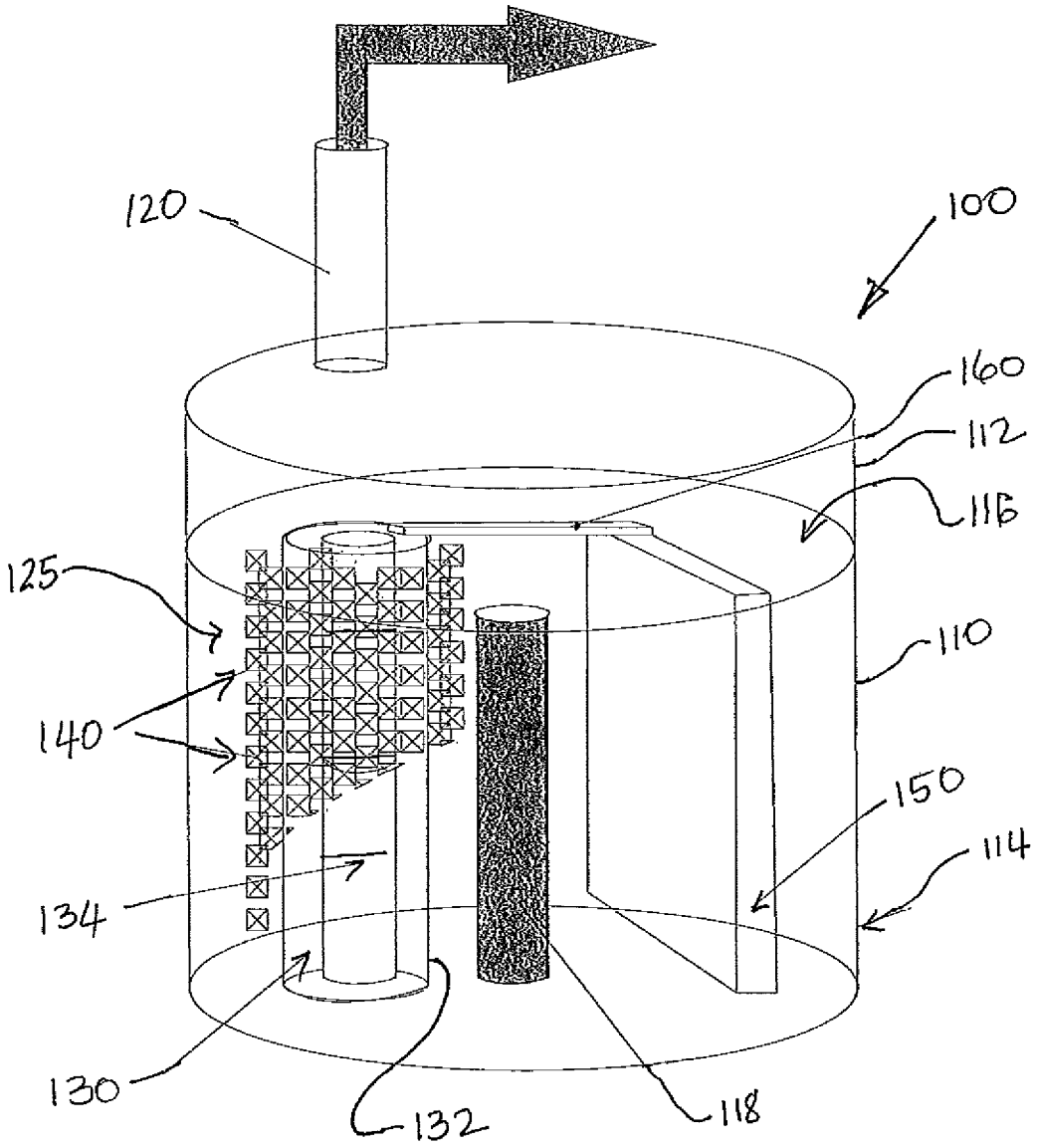
FIG. 1 illustrates a simplified, exemplary embodiment of a hydrogen-producing cell that has two electrodes.

FIG. 1 is a drawing of an exemplary two-electrode hydrogen generator 100, which does not require the application of an external electrical current. The configuration and materials may vary and those skilled in the art will appreciate that actual configurations may be influenced by capacity for hydrogen generation, electrode size, electrode materials, and other parameters.

Briefly, the generator 100 of FIG. 1 includes a housing 110 that is divided horizontally into an upper portion 112 and a lower portion 114 by a septum 116. The lower portion contains two electrodes 130 and 150. The electrodes 130, 150 are electrically connected by a conductive element 160.

Generator 100 commences operation when electrolyte 125 is supplied through electrolyte feeder tube 118 from the upper portion 112 of the housing 110 to the lower portion 114. When the electrolyte 125, described below, enters the lower portion 114 through the feeder tube 118, a chemical reaction begins and the aluminum electrode 150 is consumed as the reaction proceeds. The chemical reactions are described below. The chemical reactions, and hydrogen production from the reactions, can be terminated by the removal of the electrolyte 125 through the feeder tube 118, or by another means including, but not limited to, a drain line at the base of housing 110, not shown. Hydrogen gas produced at electrode 130 is exhausted through vent tube 120. The production of hydrogen continues until all the consumables are consumed. The consumables include water and the electrode 150.

The exemplary generator of FIG. 1 includes an electrode 150 that is composed of aluminum. The other electrode, electrode 130, is a composite structure and is composed of three elements. In this exemplary embodiment, composite electrode 130 includes firstly a non-ferrous tube electrically-conductive element, such as a copper tube 132. Copper tube 132 encloses in its annular cavity either a single magnet or a plurality of magnets 134. Electrode 130 secondly includes one or more cylindrical magnets 134. These magnet(s) 134 may be diametrically polarized rather than axially polarized, to enhance performance, but either will suffice to the task. Diametric polarization may provide greater efficiency in hydrogen generation. Thirdly, the electrode 130 includes nano-particles 140 attracted by magnet(s) 134 that adhere by magnetic force to at least a portion of the outer surface of tube 132. While these nano-particles are shown schematically as spaced from the tube 132, for reasons of clarity, they are in fact held to the outer surface of tube 132 to thereby complete the structure of electrode 130. The nano-particles 140 may be selected from magnetic particles such as nickel, iron, tungsten, cobalt, and the like, and their alloys. Because of its multiple structural features, electrode 130 may be regarded as a "composite electrode."

Because of their high surface area to volume ratio, the nano-particles provide a very large surface area from which the electrode 130 releases hydrogen, when the two electrodes 130, 150 are connected to each other electrically via connector 160. To be operative, the conductive electrical connection 160 connects electrodes 130 and 150 to complete a circuit. Accordingly, hydrogen production may be stopped by opening this electrical connection but chemical reaction with the electrolyte and erosion of the aluminum electrode 150 will continue for some time. Hydrogen production may also be controlled by controlling the electrical resistance of connector 160 either through material selection, or through dimensions, or by adding a variable, controllable resistance element to it.

The exemplary electrolyte 125 is aqueous and is produced from a liquid mixture that includes colloidal silver, colloidal magnesium, and sodium hydroxide and potassium hydroxide dissolved in distilled water. Zinc is placed in this liquid mixture along with a nickel electrode. The zinc is allowed to digest and the resulting liquid mixture, after removal of any excess undigested zinc, is the electrolyte 125.

In another exemplary embodiment, that may be scaled up or down as to volumes and weights, the exemplary electrolyte includes:

50 ml colloidal silver
50 ml colloidal magnesium
50 ml distilled water
20 grams sodium hydroxide
20 grams potassium hydroxide This mixture may be placed in a container that includes a nickel electrode and a zinc electrode of about 7 grams of elemental zinc. The zinc is allowed to digest. After digestion, the remaining zinc is removed. The liquid mixture produced is an example of an electrolyte.

It is theorized, without being bound, that in the generator 100 of FIG. 1, an exchange reaction takes place on the surface of the aluminum electrode 150 with the zinc hydroxide in the electrolyte solution. This reaction forms metallic zinc on the surface of the aluminum. This metallic zinc in turn reacts with the nano-particles 140 producing hydrogen gas at electrode 130.

It is further theorized, without being bound, that during hydrogen production, the zinc hydroxide of the electrolyte is reduced to zinc on the aluminum electrode. The zinc reacts with the nano-nickel (or nano-particles of iron, cobalt, tungsten, and the like) in the strong base electrolyte, thereby producing hydrogen on the nano-particle covered electrode 130.

It was observed that there is some hydrogen produced off the surface of the aluminum electrode 150. It is theorized, without being bound, that this results in an apparent greater hydrogen production than might be expected from stoichiometry. This hydrogen, it is believed without being bound, results from a further reaction that converts ZnOH to Zn and a reaction converting the aluminum to form $Al_2O_3$. It is theorized, without being bound, that the following reactions A, B take place:

$$6ZnOH+4Al=6Zn+2Al_2O_3+3H_2 \quad [A]$$

$$2Zn+NaOH/KOH(\text{in presence of Nickel})+2H_2O=2ZnOH+NaOH/KOH+H_2 \quad [B]$$

Regardless of any theory, the exemplary hydrogen generator of FIG. 1 provides a controlled rate of hydrogen production.

Figure 2:
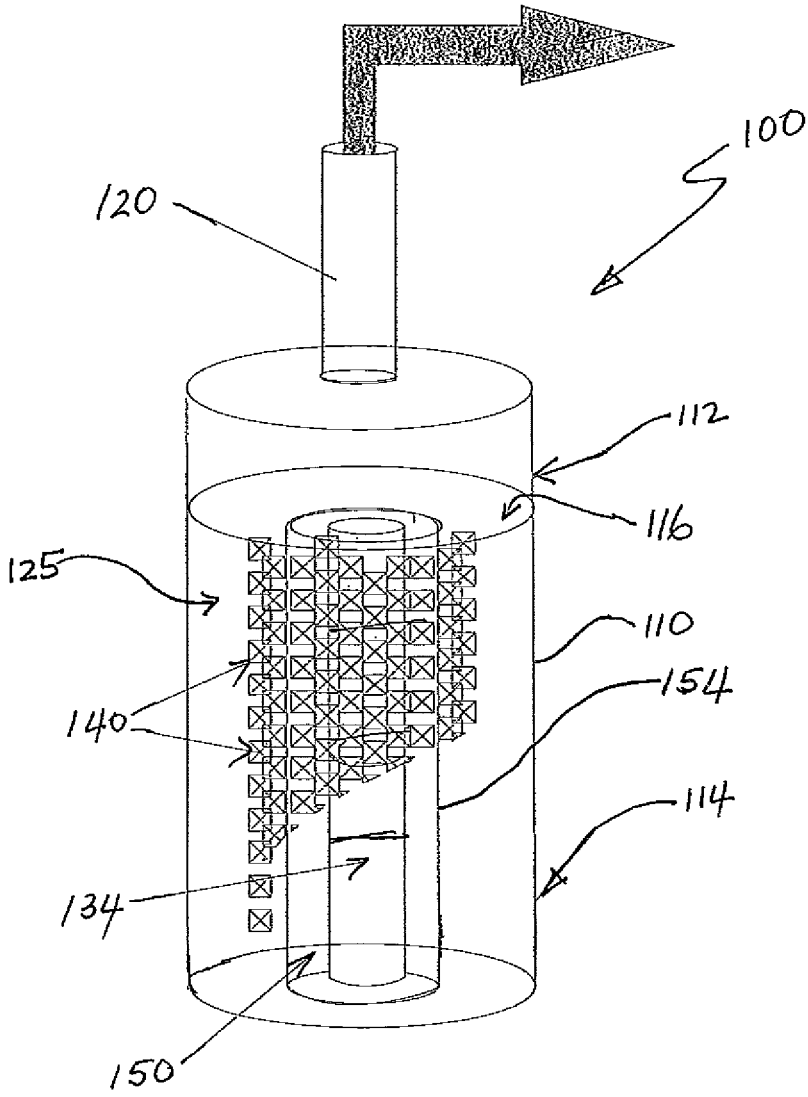
FIG. 2 illustrates an alternative exemplary embodiment of a hydrogen-producing cell.

FIG. 2 illustrates an alternative exemplary embodiment. In this embodiment, the generator 100 also includes a housing 110 divided into upper 112 and lower 114 portions by a horizontal septum 116. In comparison with the example of FIG. 1, the non-ferrous tube 132 is eliminated. Instead, composite electrode 150 includes a housing with a cavity, such as an aluminum tube 154 that houses one or more cylindrical magnets 134 in its annular space. As in the embodiment of FIG. 1, nano-nickel particles 140 in the electrolyte 125 are attracted to the outer surface of the aluminum tube 154 of an electrode 150 and form a coat on the surface held in place by magnetic fields. Once the outer surface of the tube 132 is at least partially coated with magnetically-adhering nano-particles, the nano-particles effectively form the second electrode, which is in direct contact with the aluminum tube 154 that is the first electrode. Hydrogen is produced from this nano-particle-coated surface. Since the nano-particles 140 are in direct electrical communication with the aluminum tube 154 of electrode 150, an electrical connector 160 is not required to connect the nano-particles to the aluminum electrode housing 154.

Hydrogen production rate and volume is similar to the embodiment of FIG. 1, but the overall generator complexity and cost is reduced. To control hydrogen production, the extent of the immersion of the electrode 150 in the electrolyte 125 may be controlled. In one mode of operation, the electrode 150 is lowered or raised in the solution to control the hydrogen production rate.

EXAMPLES

A number of experiments were performed to determine the hydrogen production based on the consumption of aluminum.

One gram of aluminum will produce 1.23 liters of hydrogen. The results appear to indicate producing hydrogen in an amount greater than might be expected. In all of these experiments, the generator was in accordance with FIG. 2, and the electrolyte was produced as follows. The following components were mixed together:

50 ml colloidal silver
50 ml colloidal magnesium
50 ml distilled water
20 grams sodium hydroxide
20 grams potassium hydroxide This mixture was placed in a beaker containing a nickel electrode. To this was added 7 grams of elemental zinc, connected to the nickel electrode, and the zinc was allowed to digest, thereby producing electrolyte 125. The nickel electrode and any remaining zinc were then removed. The resulting liquid was used as the electrolyte.

Experiment 1

7.5 grams of aluminum produced 10.19 liters of hydrogen @ STP. Based on stoichiometry, 7.5 grams should produce only 9.2 liters of hydrogen.

Experiment 2

2.9 grams of aluminum produced 4.163 liters of hydrogen @ STP. Based on stoichiometry, 2.9 grams of aluminum should produce 3.567 liters of hydrogen.

Experiment 3

4.1 grams of aluminum produced 8.7 liters of hydrogen @ STP. Based on stoichiometry, 4.1 grams of aluminum should produce 5.041 liters of hydrogen.

Experiment 4

2.6 grams of aluminum produced 3.57 liters of hydrogen @ STP. Based on stoichiometry, 2.6 grams of aluminum should produce 3.198 liters of hydrogen.

The average hydrogen production was 1.5 liters per gram of aluminum. All of the experiments were performed by water displacement using a calibrated column, the temperature and atmospheric pressure were recorded and the volume of hydrogen corrected to standard pressure and temperature.

While several exemplary embodiments have been presented in the foregoing detailed description of the invention and in the foregoing non-limiting examples, it should be appreciated that a multiplicity of variations exists. It should also be appreciated that the exemplary embodiment or exemplary embodiments are only examples, and are not intended to limit the scope or applicability of the technology in any way. Rather, the foregoing detailed description will provide those skilled in the art with a convenient roadmap for implementing an exemplary embodiment of the invention, it being understood that various changes may be made in the specific components described in an exemplary embodiment without departing from the scope of the invention, as set forth in the appended claims and their legal equivalents.

What is claimed is:

1. An apparatus for generating hydrogen without application of an outside source of electricity, the apparatus comprising:

an outer housing having an interior divided into an upper portion and a lower portion separated by a septum, the lower portion containing an electrolyte comprising zinc hydroxide dissolved therein; and an electrode immersed at least partially in the electrolyte, wherein the electrode comprises a non-ferrous, conductive electrode housing enclosing at least one magnet, wherein an outer surface of the electrode housing is at least partially covered with nano-particles held in place by magnetic attraction of the at least one magnet; and a vent in communication with the upper portion of the interior of the outer housing.

2. The apparatus of claim 1, wherein the electrolyte comprises zinc hydroxide, potassium hydroxide, sodium hydroxide, colloidal silver, colloidal magnesium, and water.

3. The apparatus of claim 1 wherein the electrode comprises aluminum.

4. The apparatus of claim 1 further comprising a second electrode.

5. The apparatus of claim 1, wherein the nano-particles comprise nano-particles of any one or more of nickel, tungsten, iron, cobalt, and their magnetic alloys.

6. A method of generating hydrogen gas without applying electricity from an outside source, the method comprising:

providing an electrolyte comprising zinc hydroxide;

disposing a first electrode in the provided electrolyte, the first electrode comprising an aluminum tube having a cavity formed therein, the cavity containing at least one magnet;

forming a second electrode directly on the first electrode by magnetically attracting nano-particles onto an outer surface of the aluminum tube;

producing hydrogen gas at the second electrode without applying an external current to the second electrode; and collecting the hydrogen gas produced.

7. The method of claim 6 further comprising controlling a rate of hydrogen production by controlling a level of immersion of the aluminum tube in the electrolyte.

8. The method of claim 6 wherein providing an electrolyte comprises providing an electrolyte comprising: zinc hydroxide, potassium hydroxide, sodium hydroxide, colloidal silver, colloidal magnesium, and water.

9. The method of claim 6 wherein producing hydrogen gas includes attracting nano-particles of nickel onto the outer surface of the aluminum tube of the electrode.

10. The method of claim 6, wherein producing hydrogen gas includes attracting nano-particles of any one or more of nickel, tungsten, iron, cobalt, and their magnetic alloys onto the outer surface of the aluminum tube.

* * * * *